US010066577B2

(12) United States Patent
Maki et al.

(10) Patent No.: US 10,066,577 B2
(45) Date of Patent: Sep. 4, 2018

(54) EXTRUDED CYLINDER LINER

(71) Applicant: Ford Global Technologies, LLC, Dearborn, MI (US)

(72) Inventors: Clifford E. Maki, New Hudson, MI (US); Antony George Schepak, Howell, MI (US); Mathew Leonard Hintzen, Stockbridge, MI (US); James Maurice Boileau, Novi, MI (US); Mark W. Thibault, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 173 days.

(21) Appl. No.: 15/056,201

(22) Filed: Feb. 29, 2016

(65) Prior Publication Data

US 2017/0248097 A1 Aug. 31, 2017

(51) Int. Cl.
*F02B 77/02* (2006.01)
*F02F 1/00* (2006.01)
(Continued)

(52) U.S. Cl.
CPC ..... *F02F 1/004* (2013.01); *B21C 23/00* (2013.01); *B21C 23/085* (2013.01);
(Continued)

(58) Field of Classification Search
CPC ..... F02B 77/02; F02F 1/004; B21C 23/085
See application file for complete search history.

(56) References Cited

U.S. PATENT DOCUMENTS 3,276,082 A 10/1966 Thomas
4,537,167 A 8/1985 Eudier et al.
(Continued)

FOREIGN PATENT DOCUMENTS

CN 101935783 B 1/2011
CN 102699081 A 10/2012
(Continued)

OTHER PUBLICATIONS

W. Tang, A.P. Reynolds, Production of wire via friction extrusion of aluminum alloy machining chips, 2010, Elsevier, Journal of Materials Processing Technology, pp. 2231-2237.*
(Continued)

*Primary Examiner* — Jacob Amick
*Assistant Examiner* — Charles Brauch
(74) *Attorney, Agent, or Firm* — Julia Voutyras; Brooks Kushman P.C.

(57) ABSTRACT

Extruded cylinder liners and methods of forming the same are disclosed. The extruded engine cylinder liner may include a cylindrical body having a longitudinal axis and defining an inner surface and an outer surface. A plurality of spaced apart features may protrude from the outer surface and may extend in a direction oblique to the longitudinal axis. The method may include extruding a metal material through a die to form a cylindrical body defining an inner surface and an outer surface and a plurality of spaced apart features protruding from the outer surface. The die may be rotated about a longitudinal axis during at least a portion of the extruding step such that the features extend in a direction oblique to the longitudinal axis. The oblique features may allow parent casting material to enter channels therebetween and prevent the liner from moving in the vertical and horizontal directions.

17 Claims, 6 Drawing Sheets

(51) Int. Cl.

| | |
|---|---|
| ***B21C 23/08*** | (2006.01) |
| ***B21C 23/00*** | (2006.01) |
| ***B21C 23/14*** | (2006.01) |
| ***B22D 19/00*** | (2006.01) |

(52) U.S. Cl.
CPC ..... *B21C 23/142* (2013.01); *B22D 19/009* (2013.01); *F02B 77/02* (2013.01)

(56) References Cited

U.S. PATENT DOCUMENTS

| | | | | |
|---|---|---|---|---|
| 5,255,433 | A * | 10/1993 | Jin | C22C 1/1094 164/97 |
| 5,566,450 | A | 10/1996 | Rao et al. | |
| 5,671,532 | A | 9/1997 | Rao et al. | |
| 5,842,109 | A | 11/1998 | Akpan et al. | |
| 5,891,273 | A | 4/1999 | Rueckert et al. | |
| 6,044,820 | A | 4/2000 | Domanchuk et al. | |
| 6,328,026 | B1 | 12/2001 | Wang et al. | |
| 6,354,259 | B2 | 3/2002 | Fischer et al. | |
| 7,014,924 | B2 | 3/2006 | Koyama et al. | |
| 7,059,290 | B2 | 6/2006 | Ishikawa et al. | |
| 7,273,029 | B2 * | 9/2007 | Oda | F02F 1/004 123/193.2 |
| 7,513,236 | B2 | 4/2009 | Miyamoto et al. | |
| 8,037,860 | B2 | 10/2011 | Takami et al. | |
| 8,122,941 | B2 | 2/2012 | Kim et al. | |
| 8,859,041 | B2 | 10/2014 | Sekikawa et al. | |
| 2003/0000086 | A1 * | 1/2003 | Fuganti | B22D 19/0009 29/888.061 |
| 2005/0016489 | A1 | 1/2005 | Endicott et al. | |
| 2010/0059012 | A1 * | 3/2010 | Tachibana | F02F 1/004 123/193.2 |
| 2010/0095838 | A1 * | 4/2010 | Hittle | F02F 1/163 92/171.1 |
| 2011/0232478 | A1 | 9/2011 | Horigome et al. | |
| 2015/0144090 | A1 | 5/2015 | Shin et al. | |

FOREIGN PATENT DOCUMENTS

| | | | |
|---|---|---|---|
| GB | 2 259 996 | A | 3/1993 |
| JP | 51151229 | | 12/1976 |
| JP | 51151414 | A | 12/1976 |
| JP | 5734346 | | 7/1982 |
| JP | 02104462 | A | 4/1990 |
| JP | 5086964 | B2 | 4/2010 |
| KR | 20090006502 | A | 1/2009 |
| WO | 2014134694 | A1 | 9/2014 |

OTHER PUBLICATIONS

Adachi, S. et al., "Development of cylinder liner in the new rapidly solidified aluminum alloy extruded material," J. of Japan Institute of Light Metals, v. 53, n. 2 (2003), pp. 76-81.

Morawitz, U. et al., "Benefits of Thermal Spray Coatings in Internal Combustion Engines, with Specific View on Friction Reduction and Thermal Management," SAE International, published Apr. 8, 2013, 8 pgs.

Okaniwa, S. et al, "Extrusion Technology for Aluminum Cylinder Liners Using a Rapidly Solidified Powder Alloy," Light Metal Age, Jun. 2003, pp. 22-26.

* cited by examiner

EXTRUDED CYLINDER LINER

TECHNICAL FIELD

The present disclosure relates to extruded cylinder liner, for example, for aluminum cast engine blocks.

BACKGROUND

Aluminum engine blocks generally include a cast iron liner or, if liner-less, include a coating on the bore surface. Cast iron liners generally increase the weight of the block and result in mismatched thermal properties between the aluminum block and the cast iron liners. For liner-less blocks, a sizeable investment may have to be made for each block that will receive a coating (e.g., a plasma coated bore process). The logistics to manufacture a liner-less block may be complex, which can increase the cost of production. In addition, geometric dimensional control to allow a uniform plasma coating thickness from top to bottom of the cylinder bore may be difficult.

SUMMARY

In at least one embodiment, an extruded engine cylinder liner is provided. The liner may include a cylindrical body having a longitudinal axis and defining an inner surface and an outer surface; and a plurality of spaced apart features protruding from the outer surface, the features extending in a direction oblique to the longitudinal axis.

The plurality of spaced apart features may define a plurality of channels between adjacent features, the channels extending in a direction oblique to the longitudinal axis. The features may extend along an entire height of the cylindrical body. In one embodiment, the features are equally spaced apart around a circumference of the outer surface. In another embodiment, the features extend in the direction oblique to the longitudinal axis along an entire height of the cylindrical body. The features may include a portion that extends in a direction parallel to the longitudinal axis. In one embodiment, the features extend in a direction that is 5 to 85 degrees from the longitudinal axis. In another embodiment, the features extend in a direction that is 20 to 70 degrees from the longitudinal axis. The features may have a rectangular or triangular cross-sectional shape.

In at least one embodiment, an engine block is provided. The engine block may include a body including a first material and at least two cast-in cylinder liners including a second material; the cylinder liners each including a plurality of spaced apart features protruding from an outer surface thereof and extending in a direction oblique to a longitudinal axis of the liner; and the first material surrounding and extending between the features.

The plurality of spaced apart features may define a plurality of channels between adjacent features, the channels extending in a direction oblique to the longitudinal axis. The first material may substantially fill the plurality of channels. In one embodiment, the first material surrounding and extending between the features resists relative movement between the cast-in cylinder liners and the body in a vertical and a horizontal direction. A feature of a first cast-in cylinder liner may be directly adjacent to a channel of a second cast-in cylinder liner.

In at least one embodiment, a method of forming a cylinder liner is provided. The method may include extruding a metal material through a die to form a cylindrical body defining an inner surface and an outer surface and a plurality of spaced apart features protruding from the outer surface; and rotating the die about a longitudinal axis during at least a portion of the extruding step such that the features extend in a direction oblique to the longitudinal axis.

The die may be continuously rotated during the extruding step such that the features extend in a direction oblique to the longitudinal axis over an entire length of the cylinder liner. In another embodiment, the die is not rotated during at least a portion of the extruding step such that the features extend in a direction parallel to the longitudinal axis over a portion of a length of the cylinder liner. The method may include sectioning the extruded metal material into a plurality of cylinder liners after the extruding and rotating steps. The method may also include applying a wear-resistant coating to the inner surface after the extruding and rotating steps and prior to sectioning the extruded metal material. In one embodiment, the die is rotated such that the features extend in a direction that is 20 to 70 degrees from the longitudinal axis.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
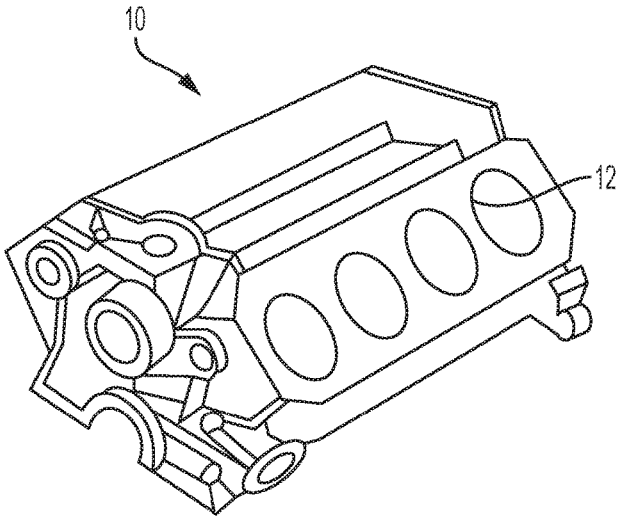
FIG. 1 is a schematic perspective view of an engine block.
Figure 2:
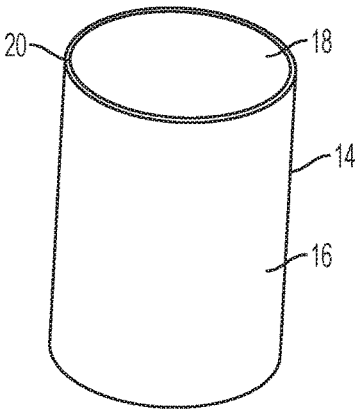
FIG. 2 is a perspective view of a cylinder liner, according to an embodiment.

With reference to FIG. 1, an engine or cylinder block 10 is shown. The engine block 10 may include one or more cylinder bores 12, which may be configured to house pistons of an internal combustion engine. The engine block body may be formed of any suitable metal material, such as aluminum, cast iron, magnesium, or alloys thereof. In addition, the engine block may be formed of non-metal materials, such as fiber-reinforced composites (e.g., carbon, glass, boron, or ceramic fibers, etc.) or ceramic-based materials. In at least one embodiment, the cylinder bores 12 in the engine block 10 may include cylinder liners 14, such as shown in FIG. 2. The liners 14 may be a hollow cylinder or tube having an outer surface 16, an inner surface 18, and a wall thickness 20. In at least one embodiment, the liner(s) 14 may be cast in to the engine block 10. Commonly owned and co-pending U.S. application Ser. No. 14/972,144 filed Dec. 17, 2015, discloses cast-in cylinder liners and the disclosure of said application is hereby incorporated in its entirety by reference herein. The liners 14 disclosed herein may be incorporated into the casting-in process of the above application.

In conventional engine blocks, if the engine block parent material is aluminum, then a cast iron liner or a coating may be provided in the cylinder bores to provide the cylinder bore with increased strength, stiffness, wear resistance, or other properties. For example, a cast iron liner may cast-in to the engine block or pressed into the cylinder bores after the engine block has been formed (e.g., by casting). In another example, the aluminum cylinder bores may be liner-less but may be coated with a coating after the engine block has been formed (e.g., by casting).

In at least one embodiment, the disclosed engine block 10 and liners 14 may be formed of aluminum (e.g., pure or an alloy). In other embodiments, one or both of the engine block 10 and the liners 14 may be formed of a material other than aluminum. As described above the engine block may be formed of materials such as magnesium, fiber composite, or ceramic. The liners 14 may be formed of an extrudable metal. Accordingly, the block 10 and the liners 14 may be formed of the same material (although specific alloy may be different), or they may be different (e.g., the block/liner may be "mixed-material"). A hollow extrusion 22 may be formed to a length that is longer than a single liner 14, for example, a length of a plurality of liners. The hollow extrusion 22 may be a hollow cylinder, at least on an interior surface of the extrusion 22. However, the hollow extrusion 22 may have a non-circular outer surface and a circular inner surface. In one embodiment, the extrusion 22 may have a length of at least two liners 14, such as at least 4, 6, or 8 liners. In another embodiment, the extrusion 22 may have an absolute length of at least 2, 4, 6, or 8 feet.

Figure 3:
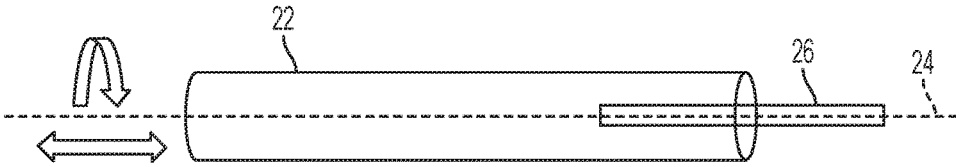
FIG. 3 is a schematic view of a liner coating system, according to an embodiment.

With reference to FIG. 3, a hollow extrusion 22 may be extruded and provided with a coating prior to being cut into individual liners 14. Prior to applying the coating, the extrusion 22 may be machined and/or subjected to other forming, shaping, or texturing processes. In one embodiment, the inner and/or outer diameter of the extrusion 22 may be adjusted before the coating, for example, by turning or other processes. Since material is being removed, the outer diameter may be reduced to a certain dimension and the inner diameter may be increased to a certain dimension. Accordingly, the extruded extrusion 22 may have an outer diameter than is larger than a final dimension of the liners 14 and an inner diameter that is smaller than a final dimension of the liners 14.

In at least one embodiment, the inner and/or outer surface of the extrusion 22 may be textured or roughened prior to the coating being applied to the inner surface. Roughening the inner surface may improve the adhesion or bonding strength of the coating to the extrusion 22 and roughening or texturing of the outer surface may improve the adhesion or bonding strength of the cylinder/liner to the parent or cast material of the engine block. The roughening processes used on the inner and outer surfaces may be the same or different. The roughening process may be a mechanical roughening process, for example, using a tool with a cutting edge, grit blasting, or water jet. Other roughening processes may include etching (e.g., chemical or plasma), spark/electric discharge, or others.

In at least one embodiment, the extrusion 22 and liners 14 derived therefrom may be formed of aluminum, such as an aluminum alloy. The aluminum alloy may be a heat treatable alloy, for example, an alloy that can be precipitation or age hardened. In one embodiment, the extrusion 22 and liners 14 may be formed of a 2xxx series aluminum alloy. The 2xxx series of aluminum alloys (e.g., according to the IRDS) includes copper as the major or principal alloying element (generally from 0.7 to 6.8 wt. %) and can be precipitation hardened to very high strength levels (relative to other aluminum alloys). The 2xxx series can generally be precipitation hardened to strengths greater than all but the 7xxx series of aluminum alloys. The 2xxx series alloys also retain high strength at elevated temperatures, such as about 150° C. For example, a comparison of a common 2xxx series alloy, 2024, and a common 6xxx series alloy, 6061, at a T6 temper (precipitation hardened to peak strength) and at room temperature and 150° C. is shown in Table 1 below:

TABLE 1

Comparison of mechanical properties.

| | Test Temperature | | | | |
|---|---|---|---|---|---|
| | 25° C. | | | 150° C. | |
| | Alloy & Heat-Treatment | | | | |
| | 2024-T6 | 6061-T6 | Typical Gray Cast Iron Used in Liners | 2024-T6 | 6061-T6 |
| Ultimate Tensile Strength (MPa) | 476 | 310 | 360 (min.) | 310 | 234 |
| Yield Strength (MPa) | 393 | 296 | — | 248 | 214 |
| % Elongation | 10 | 17 | — | 17 | 20 |
| 500 kg. Brinell Hardness | 130 | 95 | — | — | — |

TABLE 1-continued

| Comparison of mechanical properties. | | | | | |
|---|---|---|---|---|---|
| | Test Temperature | | | | |
| | 25° C. | | | 150° C. | |
| | Alloy & Heat-Treatment | | | | |
| | 2024-T6 | 6061-T6 | Typical Gray Cast Iron Used in Liners | 2024-T6 | 6061-T6 |
| Relative Machinability (A = Best, E = Poorest) | B (Requires chip breakers to avoid continuous chips) | C (Continuous chips that are difficult to control) | A | — | — |

As shown in the table, the 2xxx series alloy, 2024, has a significantly higher UTS and YS at both room temperature (25° C.) and at an elevated temperature (150° C.). In fact, the UTS of the 2024 aluminum at 150° C. is equal to the UTS of the 6061 aluminum at room temperature. The 2024 aluminum also has a higher hardness. While the properties may vary based on the specific alloys within the 2xxx and 6xxx series, the general trends described above hold. For example, the extrusion 22 may be formed of a 2xxx series aluminum alloy having a UTS of at least 400, 425, 450, or 475 MPa and a YS of at least 300, 325, 350, 375, or 390 MPa at room temperature (e.g., 25° C.). While a T6 temper is shown in Table 1, other tempers may be used, such as T4, T5, or T351.

Table 1 also includes the UTS for a typical gray cast iron used for cylinder liners. As shown, the UTS for the cast iron is at least 360 MPa. The gray cast iron is therefore significantly stronger than the 6061 alloy, but has a UTS significantly lower than the 2024 alloy. The minimum UTS for conventional cast iron liners is substantially higher than the UTS of the 6xxx series, therefore, 6xxx series alloys may be unsuitable in some embodiments. In addition, gray cast iron typically has a fatigue strength of less than 75 MPa (e.g., about 62 MPa) and a thermal conductivity of less than 50 W/m-K (e.g., about 46.4 W/m-K). In contrast, the extrusion 22 and liners 14 may be formed of a 2xxx series aluminum alloy (e.g., 2024) having a fatigue strength of at least 100 MPa, such as at least 110, 120, or 130 MPa (e.g., 138 MPa) and a thermal conductivity of at least 100 W/m-K, such as at least 110 or 120 W/m-K (e.g., 121 W/m-K).

The 2xxx series of aluminum alloys may be less corrosion resistant than other alloy series, such as the 6xxx series. However, it has been discovered that the coating applied to the extrusion 22 may alleviate the corrosion potential. Accordingly, it has been discovered that a 2xxx series aluminum alloy may be used to form the cylinder liners 14. The alloy may have a higher UTS, YS, fatigue strength, and thermal conductivity than conventional cast iron liners and may have signifantly higher UTS and YS than other aluminum alloys, such as the 6xxx series.

In addition, while a high elongation to failure is typically a positive property, it has been discovered that the lower elongation to failure of the 2xxx series is actually beneficial to the mechanical roughening process for the liners 14. For example, as shown in Table 1, 2024 aluminum has an elongation to failure of 10%, while the 6061 has an elongation to failure of 17%. It has been discovered that the higher elongation of the 6xxx series aluminum may result in long, wire-like material removal when using a cutting tool to roughen. This results in a surface that does not generally include discrete recesses for the coating to enter and mechanically interlock. In contrast, it has been found that the 2xxx series will more easily form such recesses. Accordingly, having reduced ductility is surprisingly a positive property of the 2xxx series aluminum compared to other alloy series (e.g., 6xxx). Non-limiting examples of specific 2xxx series alloys may include 2024, 2008, 2014, 2017, 2018, 2025, 2090, 2124, 2195, 2219, 2324, or modifications/variations thereof. The 2xxx alloys may also be defined based on mechanical properties, such as those described above (e.g., UTS, YS, fatigue strength, thermal conductivity, etc.).

In other embodiments, the extrusion 22 and liners 14 derived therefrom may be formed of a non-aluminum metal, such as magnesium or an alloy thereof. For example, the extrusion may be formed of magnesium and the engine block 10 may be formed of magnesium or aluminum (or alloys thereof). The use of a magnesium liner with a magnesium or aluminum-based engine block may reduce the potential for galvanic corrosion, specifically compared to magnesium blocks with cast iron liners.

In one embodiment, shown in FIG. 3, the extrusion 22 may be arranged on a horizontal axis 24 and rotated about the axis 24 while a coating is applied by a sprayer 26. Of course, the extrusion 22 may be arranged on any axis, such as vertical or an angle between horizontal and vertical. The sprayer 26 may be stationary, such that the rotation of the extrusion 22 causes the coating to be applied to the entire inner surface of the extrusion 22. However, in other embodiments, the sprayer 26 may rotate instead of (or in addition to) the extrusion 22.

In order to apply the coating along an entire length of the extrusion 22, or at least 75%, 85%, or 95% of the length of the extrusion 22, the extrusion 22 may be moved in a direction parallel to its longitudinal axis (e.g., while also rotating about an axis). For example, as shown in FIG. 3, the extrusion 22 may be moved in the horizontal direction when the extrusion 22 is arranged on the horizontal axis 24. However, if the extrusion 22 is arranged on another axis, it may be moved in a direction parallel thereto. In embodiments where the extrusion 22 is moved along its longitudinal axis, the sprayer 26 may remain stationary. For example, as shown in FIG. 3, the extrusion 22 may rotate about the axis 24 and also move horizontally in the axial direction while the sprayer 26 remains stationary. The interior surface of the extrusion 22 may therefore be coated with a sprayed coating along a length of the extrusion 22 without moving the sprayer 26.

While the sprayer 26 may be stationary and/or non-rotating, other configurations of the extrusion 22 and the sprayer 26 may also be used. For example, the extrusion 22 may rotate along an axis but may remain stationary in the axial direction and the sprayer 26 may move in the axial direction to coat the interior surface of the cylinder. Alternatively, the sprayer 26 and the extrusion 22 may both move in the axial direction. In another embodiment, the extrusion 22 may move in the axial direction but may not rotate around an axis, while the sprayer 26 may rotate around an axis but remain in the same axial position. The extrusion 22 may also remain completely stationary—not rotating or moving axially—while the sprayer both rotates around an axis and moves in the axial direction. Accordingly, any combination of the extrusion 22 and the sprayer 26 may move in the axial direction and/or rotate around an axis in order to coat the interior surface of the cylinder along its length.

The sprayer 26 may be any type of spraying device, such as a thermal spraying device. Non-limiting examples of thermal spraying techniques that may be used include plasma spraying, detonation spraying, wire arc spraying (e.g., plasma transferred wire arc, or PTWA), flame spraying, high velocity oxy-fuel (HVOF) spraying, warm spraying, or cold spraying. Other coating techniques may also be used, such as vapor deposition (e.g., PVD or CVD) or chemical/electrochemical techniques. In at least one embodiment, the sprayer 26 may be a plasma transferred wire arc (PTWA) spraying device.

The coating that is applied by the sprayer 26 or another coating technique may be any suitable coating that provides sufficient strength, stiffness, density, Poisson's ratio, fatigue strength, and/or thermal conductivity for an engine block cylinder bore. In at least one embodiment, the coating may be a steel coating. Non-limiting examples of suitable steel compositions may include any AISI/SAE steel grades from 1010 to 4130 steel. The steel may also be a stainless steel, such as those in the AISI/SAE 400 series (e.g., 420). However, other steel compositions may also be used. The coating is not limited to steels, and may be formed of, or include, other metals or non-metals. For example, the coating may be a ceramic coating, a polymeric coating, or an amorphous carbon coating (e.g., DLC or similar). The coating may therefore be described based on its properties, rather than a specific composition.

In one example, a metallic coating may have an adhesion strength of at least 45 MPa, as measured by the ASTM E633 method. In another example, a liner may have a minimum wear depth, such as 6 μm, following a wear test. For example, a liner having a 300 μm 1010 steel-based coating applied via a Plasma Twin Wire Arc system may be tested using a Cameron-Plint test device. Using this device with the following parameters: Mo—CrNi piston ring, 5W-30 oil at a temperature of 120 C, 350 N load, 15 mm stroke length, and 10 Hz test frequency, the liner may have no more than a 6 μm wear depth after 100 hours of testing.

With reference to FIGS. 4-7, the extrusion 22 may be extruded to have a substantially cylindrical inner surface 28 and an outer surface 30. The inner surface 28 may define the inside of the hollow extrusion 22 and may receive the coating, as described above. The coated inner surface 28 may form the bore surface in the finished cylinder bore 12, after later processing. The outer surface 30 may also be cylindrical (e.g., circular in cross-section), however, it may also include texturing and/or additional features. In one embodiment, the outer surface 30 may be roughened or textured. The roughening/texturing process may be a mechanical roughening process, for example, using a tool with a cutting edge, grit blasting, or water jet. Other roughening processes may include etching (e.g., chemical or plasma), spark/electric discharge, or others. The roughened or textured outer surface 30 may provide improved bonding with the parent metal when the liner 14 is cast in to the engine block 10. The rough surface may improve bonding to due increased surface area and allow mechanical interlocking between the parent material and the liner 14.

In at least one embodiment, in addition to, or instead of, roughening or texturing, the outer surface 30 may include axial features 32. The features 32 may protrude from an otherwise cylindrical outer surface 30. Accordingly, the features 32 may also be referred to as projections. The features 32 may extend along the axial direction of the extrusion 22 (e.g., along the long-axis or in the direction of extrusion). The features 32 may extend along the entire axial dimension of the extrusion 22.

Figure 4:
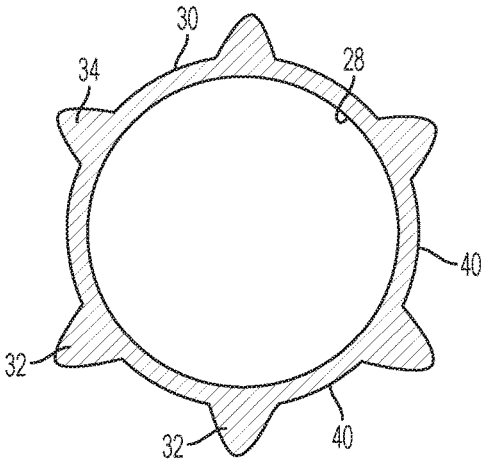
FIG. 4 is a transverse cross-section of an extrusion including rounded triangle axial features, according to an embodiment.
Figure 5:
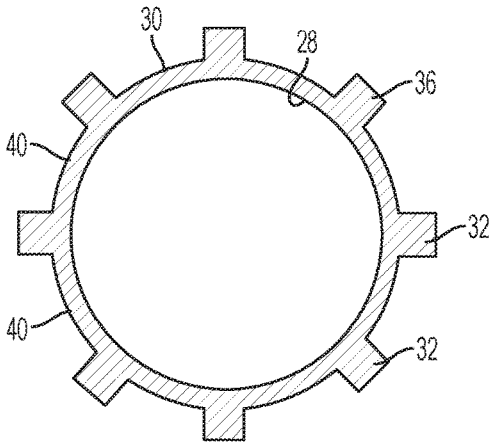
FIG. 5 is a transverse cross-section of an extrusion including rectangular axial features, according to an embodiment.
Figure 6:
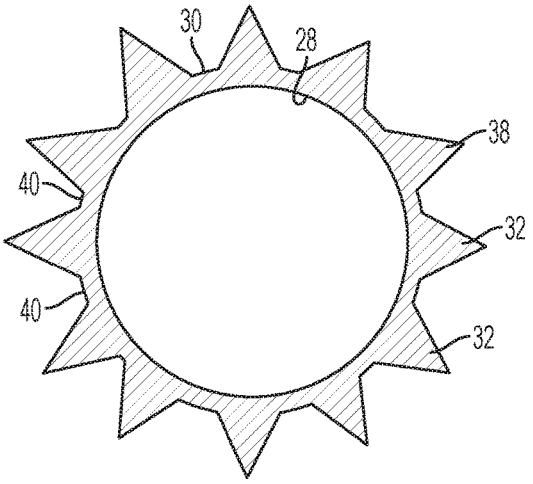
FIG. 6 is a transverse cross-section of an extrusion including triangular axial features, according to an embodiment.

In one embodiment, the features 32 may extend in a straight line in the axial direction (e.g., parallel to the longitudinal axis), such that the features do not move or rotated around the perimeter or circumference of the extrusion 22. Non-limiting examples of features 32 that extend in a straight line in the axial direction are shown in cross-section in FIGS. 4-6. In FIG. 4, the features 32 may be formed in cross-section as rounded triangles 34. In FIG. 5, the features 32 may be formed in cross-section as rectangles 36, which may of course also be squares. In FIG. 6, the features 32 may be formed in cross-section as triangles 38, which may be equilateral, isosceles, right triangles, or other. While these three cross-sectional shapes are shown in FIGS. 4-6, any suitable cross-section formable by extrusion may be used for the features 32. For example, the features 32 may be partial circles (e.g., semi-circle or half-moon), hook-shaped, saw-toothed, or others. The features 32 may also have a combination of different shapes, including any combination of those shown or described herein.

There may be any number of features 32 extending from the outer surface 30. The number of features 32 may depend on the size and/or shape of the features 32. For example, there may be at least 3 features, such as at least 5 or at least 10 features. In one embodiment, there may be 3 to 20 features, or any sub-range therein, such as 4 to 18 or 5 to 15 features 32. In the embodiments shown, the features 32 may be equally spaced and/or may be symmetrical about at least one vertical plane. However, in other embodiments, the features 32 may be unevenly spaced and/or may be asymmetrical. The spaces or gaps between the features 32 may be referred to as channels 40. In embodiments where the features 32 extend in a straight line in the axial direction, the channels 40 may also extend in a straight line. Similarly, the channels 40 may extend substantially the entire length of the extrusion 22.

The features 32 and the channels 40 formed thereby may improve the bonding or adhesion of the liners 14 to the parent metal when the liners 14 are cast therein. The features 32 and channels 40 may perform a similar function to the roughening/texturing described above, but on a larger scale. For example, when the liners 14 are cast in to the engine block 10, the parent metal may flow into the channels 40 between the features 32, thereby mechanically interlocking the liner 14 and the engine block 10. This interlocking may be in addition to any melting of the surface of the liner 14 that occurs during the casting in process, thereby forming a metallurgical or molecular bond between the parent metal and the liner. It is possible that not all of the outer surface of the liners will melt and form said metallurgical/molecular bond, therefore, the additional interlocking of the parent metal and the liners 14 due to the features 32 may provide an additional source of bonding or adhesion.

Figure 7:
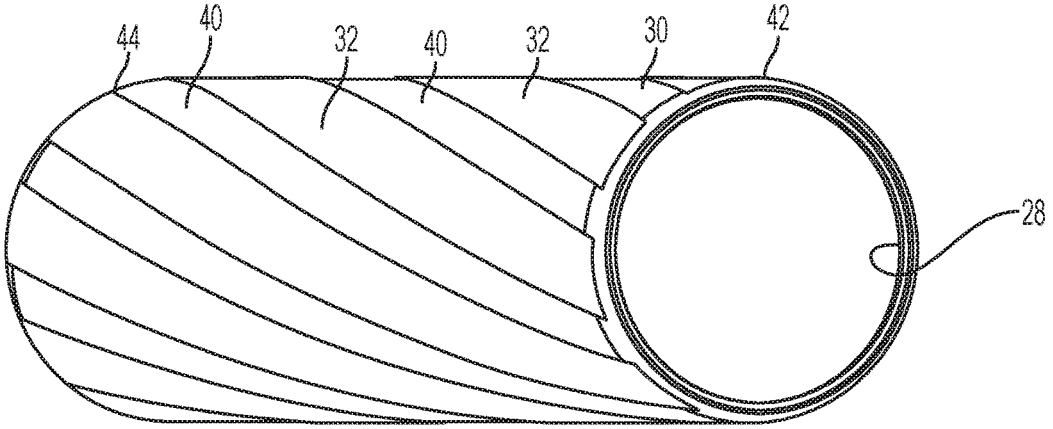
FIG. 7 is a perspective view of an extrusion including features that rotate around a perimeter of the extrusion, according to an embodiment.

With reference to FIG. 7, in at least one embodiment the features 32 may not extend in a straight line along the axial direction for their entire length (e.g., not parallel to the longitudinal axis along the entire length). For example, one or more of the features 32 may rotate and/or wrap around the perimeter of the extrusion 22 as they extend in the axial direction. Accordingly, the feature(s) 32 may extend in a direction that is oblique (i.e., not parallel or perpendicular) to the axial/longitudinal axis. The features may therefore be located at a different position along the perimeter or circumference of the extrusion 22 at one end 42 than at the other end 44. In the embodiment shown, the features 32 may constantly rotate around the perimeter of the extrusion along the entire length of the extrusion. Accordingly, the extrusion 22 may have a rifled outer surface design or configuration, similar to that of a rifle barrel. The features 32 may therefore spiral or continuously wind around the perimeter of the extrusion 22 along a length of the extrusion. The features 32 may also be referred to as helical (e.g., forming a helix around the outer surface 30). Since the features 32 may spiral or helically wrap around the perimeter, the gaps or channels 40 between the features may also spiral or helically wrap around the perimeter of the extrusion 22. The features 32 shown in FIG. 7 are rectangular in cross-section, however, helical features may be formed having any cross-sectional shape, such as those in FIGS. 4-6, others described above/below, or any other suitable shape.

While the embodiment shown has features 32 that constantly rotate around the perimeter of the extrusion 22 for its entire length, the features 32 may only rotate around the perimeter for a portion or portions of the length of the extrusion 22. For example, the features 32 may rotate around the perimeter for a certain portion of the length of the extrusion 22 and then the features 32 may extend straight for another portion of the length. There may be alternating portions of the length where the features 32 rotate around the perimeter and then are straight. The alternating portions may be relatively long or may be short discrete portions.

As described above, the extrusion 22 may be formed by extruding aluminum, such as 2xxx series aluminum. Extrusion generally includes forcing a large piece of metal, typically called a billet, through a die having an opening with the desired cross-sectional shape of the extruded part. The extrusion process may include direct or indirect extrusion. The billet may be heated to allow the metal to deform more easily. For example, aluminum billets may be heated to a temperature of 800-925° F. prior to the extrusion process. Accordingly, the die and the die opening determine the shape and cross-section of the extruded part. In the embodiments where the features 32 extend in a straight line from the beginning to the end of the extrusion, the die may be held in a static position during the extrusion. In embodiments where the features 32 rotate around the perimeter of the extrusion, either constantly or intermittently, the die may be rotated during the extrusion to cause the features 32 and channels 40 to rotate. If the features 32 are designed to rotate constantly, then the die may be rotated constantly. If the features 32 are to have portions that are straight, then the die may be held static to form straight feature portions. The rotation speed of the die may be used to at least partially control the angle of the features (e.g., other factors being constant, faster rotation will generate a larger angle).

The shape, number, width, spacing, and angle (for rifled embodiments) of the features 32 may vary depending on the liner and/or the engine block design, production parameters, and operating conditions. These parameters may be varied to provide certain bore spacing and certain minimum levels of parent metal infiltration and bond strength (e.g., very small spacing between features may prevent complete infiltration). In general, a greater number of features 32 may provide increased interlocking between the liner and the engine block, other factors being equal. For rifled liners, the vertical interlocking may generally increase with a greater angle of rotation about the perimeter of the liner.

As used herein the angle of the features may be measured from the longitudinal axis, such that an angle of 0° is no rotation (e.g., straight features, such as in FIGS. 4-6) and 90° is complete rotation. An angle of 90° is essentially impossible for an extruded liner. In at least one embodiment, the features 32 may rotate around the perimeter such that they form an angle from the longitudinal axis of at least 5°, for example, at least 10°, 20°, or 30°. In another embodiment, the features 32 may rotate around the perimeter such that they form an angle from the longitudinal axis of 5° to 89°, or any sub-range therein, such as 5° to 85°, 10° to 80°, 15° to 75°, 20° to 70°, 25° to 65°, 30° to 60°, or 40° to 50°. The channels 40 may rotate at the same angles as the features 32.

Figure 8:
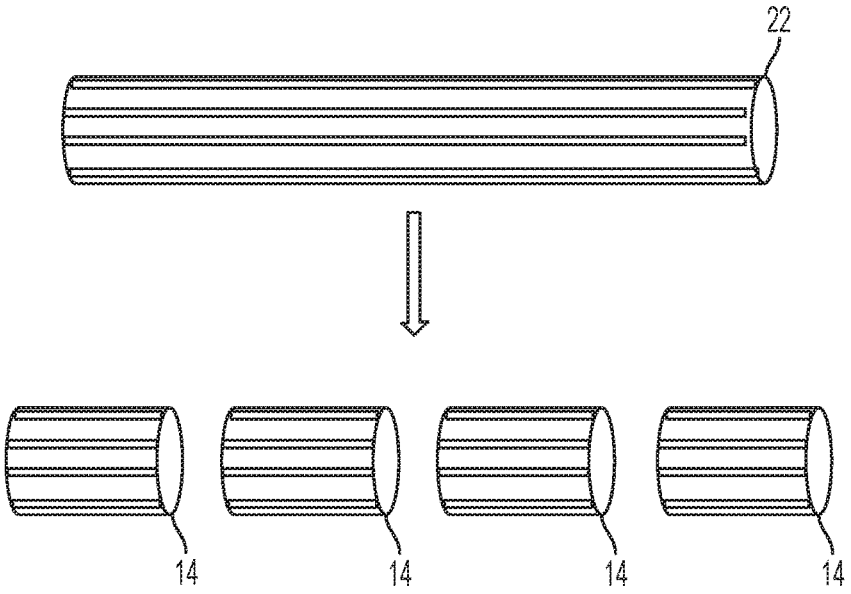
FIG. 8 is a schematic of an extruded hollow cylinder including axial features being sectioned into multiple cylinder liners, according to an embodiment.

With reference to FIG. 8, after the extrusion 22 is coated (e.g., as described above), it may be cut, sectioned, or divided into a plurality of liners 14 that are sized to be inserted into a cylinder bore 12 (e.g., by casting in). FIG. 8 shows an embodiment in which the features 32 are straight in the axial direction, however, the sectioning may also be performed on extrusions 22 having rotating features 32. The liners 14 may be cut slightly longer than their final inserted length to allow for finishing or other final machining processes. In at least one embodiment, the extrusion 22 may be cut, sectioned, or divided into at least two liners 14, such as at least 4, 6, or 8 liners, or more. The extrusion 22 may be separated into the plurality of liners 14 using any suitable method, such as cutting (e.g., saw cutting), turning (e.g., using a lathe), laser, water jet, or other machining methods. While the extrusion 22 is shown and described as coated first before being cut into multiple liners 14, it is also contemplated that the extrusion 22 may be cut first and then each liner 14 may be coated individually. However, coating the extrusion 22 first may provide improved efficiency and reduce cycle times. Coating the extrusion 22 and sectioning it into multiple liners 14 may eliminate the extra processing that is required for thermally sprayed blocks (e.g., liner-less blocks) at the final machining line or at the foundry during cubing. It also provides greater confidence that the coating was applied uniformly to the defined engineering specifications before it is cast into the block. This reduces the scrap rate and scrap cost of the completed engine block because scrapping an out-of-spec liner is much less costly in terms of expense, time, and machine-hours than scrapping an out-of-spec engine block at the end of the process.

With reference to FIGS. 9A-11, the cylinder liners 14 may be cast-in to the cylinder bores 12 in the engine block 10. As described above, the engine block 10 may be formed of any suitable material, such as aluminum, cast iron, magnesium, or alloys thereof. In at least one embodiment, the engine block 10 is formed of aluminum (e.g., pure or an alloy thereof). The engine block 10 may be a cast engine block. The engine block 10 may be cast using any suitable casting method, such as die casting (e.g., low or high pressure die casting), permanent mold casting, sand casting, or others. These casting methods are known in the art and will not be described in detail. One of ordinary skill in the art, in view of the present disclosure, will be able to implement the cast-in process using casting processes known in the art.

In brief, die casting generally includes forcing a molten metal (e.g., aluminum) into a die or mold under pressure. High pressure die casting may use pressures of 8 bar or greater to force the metal into the die. Permanent mold casting generally includes the use of molds and cores. Molten metal may be poured into the mold, or a vacuum may be applied. In permanent mold casting, the molds are used multiple times. In sand casting, a replica or pattern of the finished product is generally pressed into a fine sand mixture. This forms the mold into which the metal (e.g., aluminum) is poured. The replica may be larger than the part to be made, to account for shrinkage during solidification and cooling.

In embodiments where the engine block 10 is formed of aluminum, it may be any suitable aluminum alloy or composition. Non-limiting examples of alloys that may be used as the engine block parent material include A319, A320, A356, A357, A359, A380, A383, A390, or others or modifications/variations thereof. The alloy used may depend on the casting type (e.g., sand, die cast, etc.). The parent aluminum alloy may be different than the liner (e.g., 2xxx series). As described above, the aluminum cylinder liners 14 may be cast-in to the cylinder bores 12 of the engine block 10. The liners 14 may be inserted into the appropriate casting components, depending on the specific casting process, prior to introduction of the molten aluminum. For example, in die casting, the cylinder liners 14 may be included in addition to, or as part of, the cores that form the cylinder bores 12.

After the liners 14 have been inserted into the mold, the casting of the engine block 10 may be performed. As a result of the casting process, the liners 14 may be incorporated into the engine block 10 (e.g., cast-in). During the casting process, the heated, liquid parent aluminum contacts the outer surface 16 of the liner 14. The high temperature of the parent aluminum may cause the outer surface 16 to melt. The melting may be localized to just the outer surface 16 of the liner 14, such that a majority of the wall thickness 20 is not affected or melted. In one embodiment, the melting of the outer surface 16 may be from 10 to 50 μm in from the outer surface, or any sub-range therein. For example, the melting may be limited to 10 to 45 μm, 15 to 40 μm, 15 to 45 μm, or 18 to 38 μm. The melting may occur on the entire outer surface 16 or only in certain portions or a certain percentage of the outer surface 16. When the parent aluminum cools and solidifies, it may therefore form a metallurgical or molecular bond with the melted portion of the outer surface 16. Accordingly, unlike a liner that is inserted after casting (e.g., by interference fit), the cast-in liner 14 may form a seamless metallurgical bond that is only detectable by metallurgical analysis. This metallurgical bond is very strong and may prevent any relative movement between the parent material and the liner (e.g., the block and the liner).

As described above, the features 32 and the channels 40 formed thereby may improve the bonding or adhesion of the liners 14 to the parent metal when the liners 14 are cast therein. For example, when the liners 14 are cast in to the engine block 10, the parent metal may flow into the channels 40 between the features 32, thereby mechanically interlocking the liner 14 and the engine block 10. It is possible that not all of the outer surface 16 of the liners will melt and form said metallurgical/molecular bond, therefore, the additional interlocking of the parent metal and the liners 14 due to the features 32 may provide an additional source of bonding or adhesion.

The additional interlocking of the parent material and the liners 14 may be especially effective in embodiments where the features 32 rotate around a perimeter of the liners 14 (over a portion or the entire length). The rotation of the features 32 around the perimeter of the liners 14 may provide interlocking in both the horizontal and vertical directions (e.g., around the perimeter and in the axial direction). Interlocking in the vertical (axial) direction may be beneficial if there is no, little, or less than complete metallurgical bonding between the parent metal and the liner 14 during the casting in process. By interlocking the parent metal and the features 32 in the vertical direction, the liner 14 may be vertically/axially held in place and not allowed to shift up or down in the vertical direction. This type of vertical interlocking may not be present in liners 14 having features 32 that are straight in the axial direction, since the features 32 are aligned parallel to the axial direction. Accordingly, the disclosed features 32 that rotate around a perimeter of the liners 14 may prevent or reduce slip of the liners 14 in the vertical/axial direction, even if there is incomplete metallurgical bonding between the parent material and the liners 14 during casting.

Figure 9A:
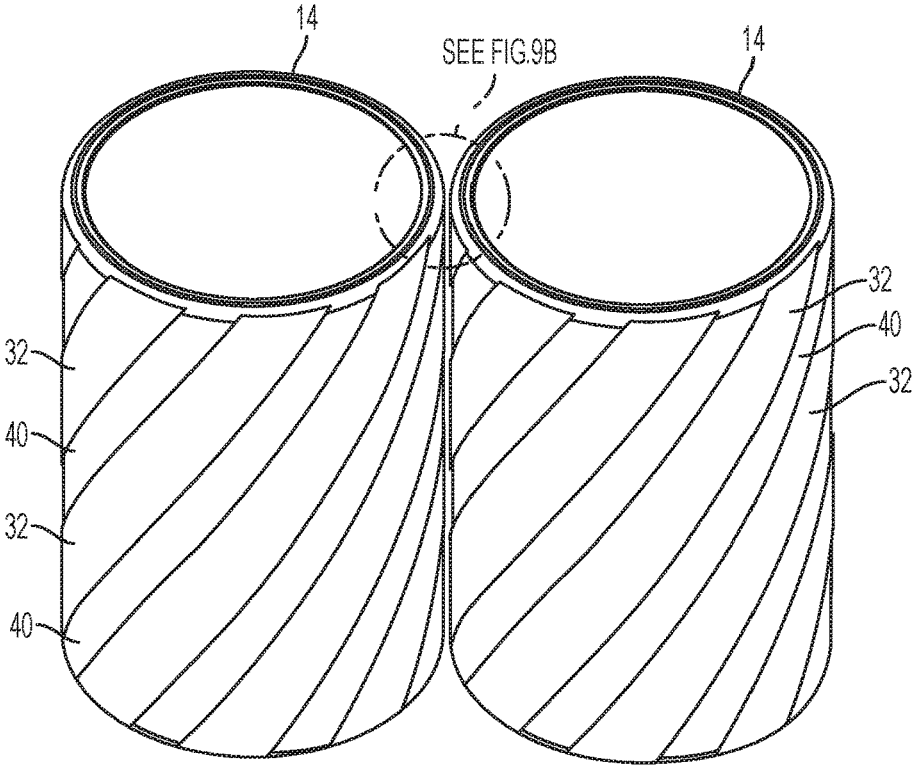
FIG. 9A is a perspective view of two adjacent cylinder liners including rotating axial features, according to an embodiment.
Figure 9B:
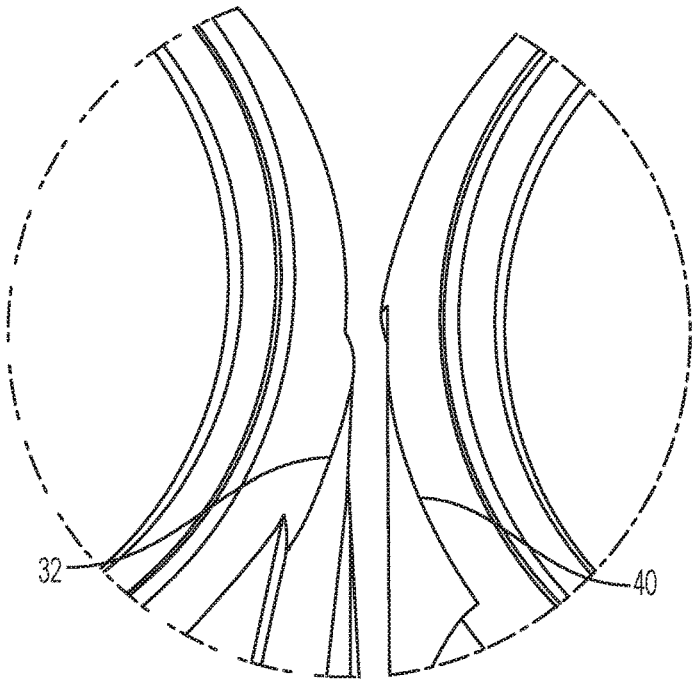
FIG. 9B is an enlarged view of FIG. 9A showing an axial feature of one liner nested in a channel of the other liner.

With reference to FIGS. 9A and 9B, the arrangement of the liners 14 may also play a role in the casting process. As shown in FIGS. 9A and 9B, the liners 14 may be arranged such that the features 32 of one liner nest at least partially in the channels 40 of another liner. As shown in the enlarged view of FIG. 9B, the feature 32 of the left liner may be disposed adjacent to or nested in a channel 40 of the right liner. The embodiment shown includes liners 14 having features 32 that rotate around a perimeter of the liner along its length, however, the nesting arrangement may be used for any of the disclosed liners with features 32. For example, the liners having features 32 shown in FIGS. 4-6 may be arranged such that the features 32 are adjacent to channels 40 in a neighboring liner.

Nesting of the liners may have several benefits. For example, nesting may ensure that there is sufficient space between the liners for the parent metal to flow during the casting process. It may also further reinforce the interlocking between the parent metal and the liners by forcing the parent metal to snake or weave between the features 32 and channels 40 of neighboring liners (e.g., in a serpentine fashion). It may also provide a more uniform parent metal thickness between neighboring liners, instead of a relatively small thickness between two adjacent features 32 and a relatively large thickness between two adjacent channels 40. However, while the shown nested arrangement may be beneficial, the disclosed liners may be placed in any arrangement.

Figure 10:
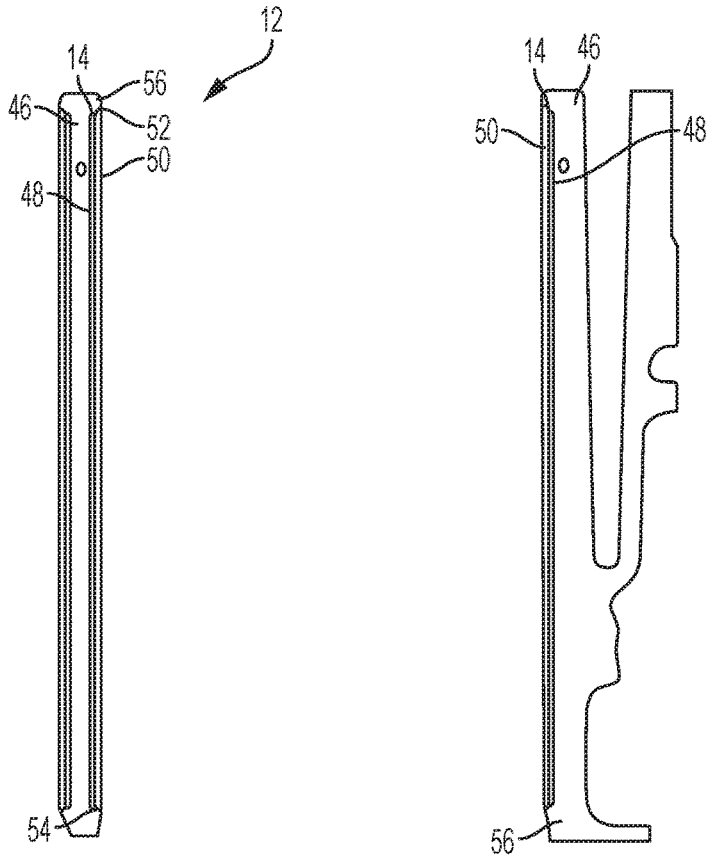
FIG. 10 shows a cross-section of a cast-in cylinder liner, according to an embodiment.

With reference to FIG. 10, a side cross-section of a single cylinder bore 12 having a cast-in liner 14 is shown. The bore wall 46 may have an interface surface 48 that delineates the parent material from the liner 14. As described above, the parent material and the liner 14 may form a metallurgical or molecular bond such that there is no gap or space between the bore wall 46 and the outer surface 16 of the liner 14. Accordingly, the interface surface 48 may not be visible without metallurgical analysis, such as etching, high-powered microscopy, compositional analysis, or other techniques capable of discerning between two molecularly bonded materials.

As described above, the liner 14 may have a coating 50 applied on its inner surface 18 prior to the casting process. Accordingly, the cast-in liner 14 may include the coating 50 on its inner surface 18 and the coating 50 may form the innermost surface of at least a portion of the cylinder bore 12. In at least one embodiment, the cylinder liner 14 may be overmolded such that the parent material of the engine block 10 surrounds the liner 14 on the outer surface 16 and on top 52 and bottom 54 of the liner 14. The parent material may surround both the aluminum and the coating 50 of the liner 14. Overmolding of the liner 14 may further lock-in or anchor the liner 14 within the engine block 10 (e.g., in addition to the molecular bonding and/or the features 32).

Stated another way, the liner 14 may be at least partially recessed within the bore wall 46 such that a portion 56 of the bore wall 46 at least partially extends over or overhangs the liner 14 on the top 52 and/or bottom 54 of the liner 14 (e.g, the aluminum and the coating). In one embodiment, the portion 56 of the bore wall 46 extends completely over or overhangs the liner 14 on the top 52 and/or bottom 54 of the liner 14. For example, a portion 56 of the bore wall 46 may be flush or substantially flush (e.g., coplanar) with the coating 50 on the top 52 and/or bottom 54 of the liner to form at least a portion of the innermost surface of the cylinder bore 12.

Figure 11:
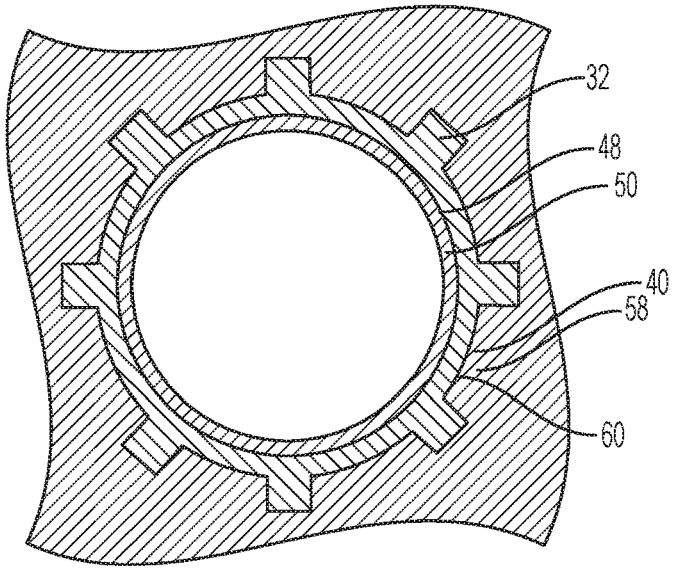
FIG. 11 is a transverse cross-section of a cast-in cylinder liner having axial features, according to an embodiment.

With reference to FIG. 11, a transverse cross-section (e.g., perpendicular to the axial direction) of an engine bore 12 having a cast-in liner 14 with features 32 is shown. Similar to the side cross-section shown in FIG. 10, the liner 14 has a coating 50 forming an innermost surface of the cylinder bore 12. An interface surface 48 delineates the parent material 58 from the outer surface 60 of the liner 14. The parent material 58 may fill the channels 40 formed between the features 32. While the features 32 are shown as rectangles and as being straight in the axial direction, the same would apply to any of the other feature shapes and for embodiments where the features 32 rotate along a circumference of the liner.

Figure 12:
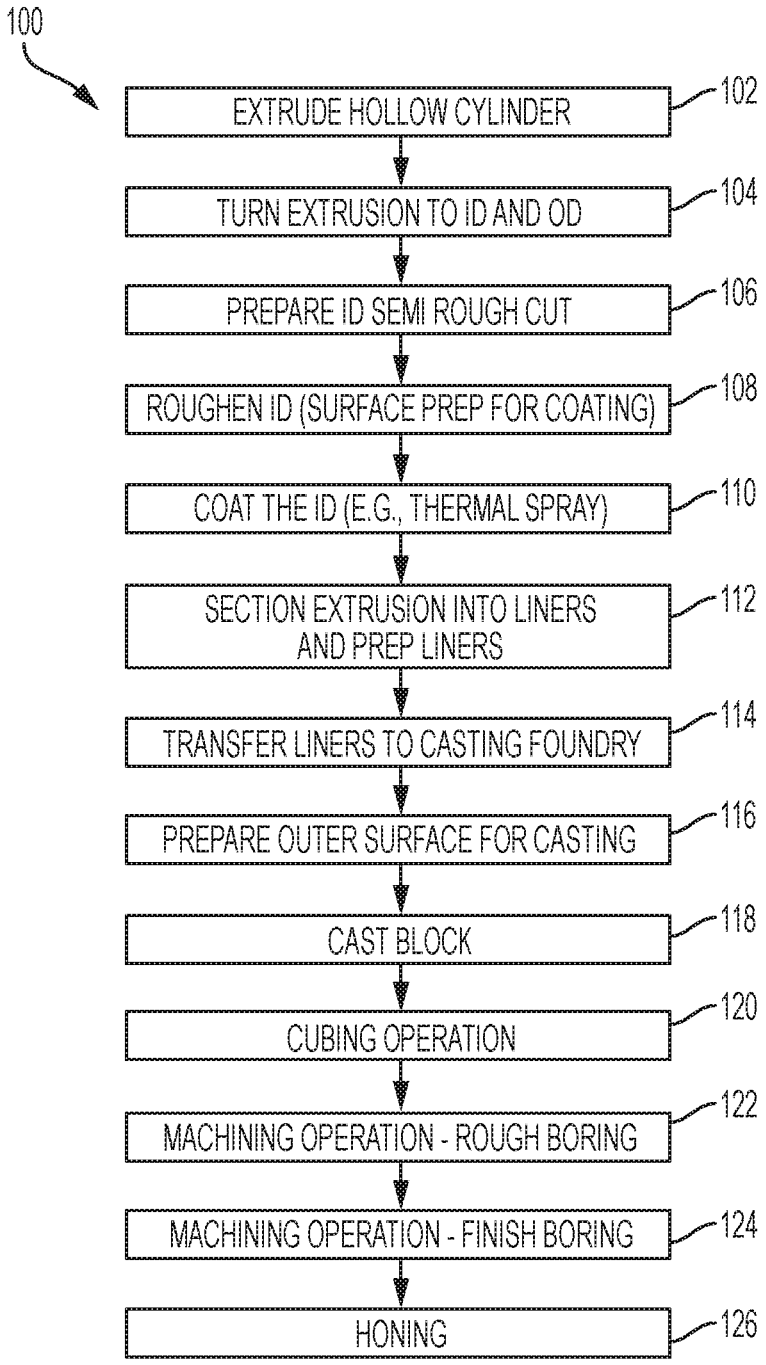
FIG. 12 is a flowchart of a method of forming an engine block with a cast-in liner, according to an embodiment.

While the various steps in forming an engine block with cast-in liners are described above, a flowchart 100 is shown in FIG. 12 describing an example of a method of forming an engine block with cast-in liners. In step 102, an elongated hollow extrusion may be extruded having a length that is multiple times the length of a single cylinder liner. As described above, the internal surface of the extrusion may be a hollow cylinder, but the external shape of the extrusion may be non-circular and may include features that extend in the axial direction. To form axial features in the extrusion, a die may be used having a corresponding die opening. To produce an extrusion where the features rotate around a circumference/perimeter of the liner, the die may be rotated during the extrusion process. The rate of rotation of the die may vary depending on the desired angle of the features, the ram pressure during extrusion, or other parameters. In step 104, the extrusion may be turned or otherwise machined to a predefined inner diameter (ID) and outer shape. For example, if there are axial features formed in the extrusion, the features may be machined to alter their shapes or to bring them to within certain tolerances. In certain embodiments, the extrusion tolerances may be tight enough that step 104 is not required.

In step 106, the ID of the extrusion may be semi rough cut. This may include removing material from the inner diameter of the extrusion in order to further refine the ID. This step may be performed using a boring process, milling process, or other material removal methods. In step 108, the ID of the extrusion may be roughened in preparation for a coating to be applied. Roughening the ID may allow the coating to better bond to the extrusion, for example by increasing the mechanical interlocking between the coating and the ID. In one embodiment, the roughening may be mechanical roughening, described above. However, other roughening methods may also be used.

In step 110, the inner diameter of the extrusion may be coated with a coating. As described above, the coating may be sprayed on, for example, using a thermal spraying process such as plasma spraying or wire arc spraying (e.g., PTWA). The coating may be applied using a stationary sprayer while the extrusion rotates around the sprayer and/or the sprayer may rotate. The sprayer or the extrusion may be moved in an axial direction to coat the ID along at least a portion of the length of the extrusion (e.g., at least 95% of the length). To control splatter of the coating outside of the extrusion, a physical shield, air curtain, air duct exhaust, or other barriers may be used. The coating may be a steel coating and the coating may be applied directly to the inner diameter of the extrusion (i.e., without any intervening coatings).

In step 112, the coated extrusion may be sectioned, divided, or cut into multiple liners. The length of the extrusion and the length of the liners to be cut therefrom may determine the number of liners that are formed from each extrusion. In at least one embodiment, at least 5 liners may be cut from a single extrusion. While the extrusion is shown as coated first and then sectioned, the extrusion may also be sectioned first and then coated, however, coating the extrusion first may provide improved efficiency. The sectioned liners may then be prepped for insertion into a die/mold. In one embodiment, the inner diameter and/or the ends of the liners may be refined. For example, the coating may not be cylindrical after step 110 and may need to be processed to improve the cylindricity. The ends of the liners may need to be processed to bring their length into specification for casting or to shape the ends to be inserted into the die/mold cores. The processing of the coated liners may depend and vary based on the type of casting to be performed, such as sand casting or die casting, etc.

In step 114, the coated liners may be transferred (e.g., shipped) to a casting foundry to be cast-in to an engine block. In the embodiment shown, steps 102-112 are performed at a different location from the casting foundry, however, some or all of the steps may take place at the foundry. In addition, steps 102-112 may take place at multiple locations such that additional shipping steps may occur between the steps. In step 116, the outer surface of the liners may be prepared for casting. For example, the liners may be treated to remove oxides from the outer surface to facilitate casting and improve bonding between the liner and the parent material. The treatment may include chemical treatment (e.g., solvents) or mechanical treatment (e.g., polishing, grinding, grit blasting).

In step 118, the engine block may be cast with the liners cast-in. As described above, the casting may be performed using die casting (e.g., HPDC), permanent mold casting, or sand casting. The liners may be cast-in using cylinder bore cores or other suitable methods. In step 120, a cubing operation may be performed. Cubing may include processing the rough casting into a semi-finished state and establishing datums for final machining. For example, the cubing step may establish the cylinder bore centers. In steps 122 and 124, rough boring and finish boring operations may be performed in order to further refine the inner diameter of the engine bores. While the steps are described as boring, other material removal processes may also be used, such as milling. Rough boring may increase the ID by a larger amount than finish boring. In step 126, a honing operation may be performed in order to further refine and finalize the inner diameter of the engine bores. The honing step may include multiple honing operations, such as rough and finish honing. Steps 120-126 may be the same or similar to the steps performed on cast iron liners. The disclosed process is therefore able to be incorporated or introduced into current manufacturing processes without completely overhauling the equipment or post-processing steps currently used. This may allow the disclosed process to be implemented in a cost and time effective manner.

The disclosed methods of forming an engine block having cast-in liners and the engine blocks formed thereby have numerous advantages and benefits over conventional engine blocks. In contrast to engine blocks in which a coating is applied after casting, the disclosed method eliminates several steps and simplifies others. For example, the steps of masking portions of the engine block to prevent coating overspray and removing the masking material are eliminated (e.g., steps #6 and #8 in the liner-less process described above). In addition to overspray, there may also be contamination from the normal machining processes. A high pressure power washing of the block may be performed to reduce or eliminate this contamination, which may add costs in terms of additional equipment and cycle time. The disclosed extruded liner, which may be sprayed and machined prior to insertion in the block, may reduce the amount of contamination that could enter the block prior to assembly and use.

In addition, to coat the bores of a cast block, either the sprayer or the entire engine block must be rotated around the bore axis. Rotating the sprayer or rotating a large, heavy engine block adds additional complexity and difficulty to the coating process. In the disclosed method, a hollow extrusion can be rotated around a stationary sprayer. In addition to simplifying the process, this may also allow for multiple different extrusion diameters and lengths to be used with a single spray setup. Other benefits may include early detection of potential defects. If bonding is not achieved in a conventional thermally sprayed liner-less block, the coating may separate from the bore. In this case, the coating must be ground out, the bore re-prepared, sprayed, and machined. If one or more of these steps is not possible, then the entire block must be scrapped. With the disclosed extruded and coated liner, any separation or defect can be detected prior to casting the liner into the block. Furthermore, the disclosed extruded liners may arrive at an engine block casting plant in a pre-coated and fully rough-machined state. Therefore, at the assembly plant, only a final machining (e.g., a final hone) may be needed. This may reduce the amount of equipment needed at the assembly plant and may result in shorter cycle times, reducing cost.

The disclosed methods and engine blocks also have advantages over cast-in iron liners or liners that are inserted after casting (e.g., by interference fit). The 2xxx series aluminum liners in the disclosed methods and engine blocks may have a lower density, higher UTS, higher fatigue strength, and higher thermal conductivity than cast iron liners. Due to the molecular, gap-free bonding between the cast-in aluminum liner and the parent aluminum, there is a reduction or elimination of leaks in the cooling paths around the engine bores. The seamless liner and engine bore also have very uniform mechanical properties around the perimeter of the bore, allowing the liner to distribute mechanical loads in addition to acting as a wear surface (the conventional purpose for the liner). The intimately bonded aluminum liner and aluminum parent material also have very similar thermal expansion properties.

The disclosed liners having a textured/roughened outer surface and/or features extending in the axial direction provide further improved bonding between the liners and the parent material of the cast engine block. The features may provide additional mechanical interlocking to prevent or reduce movement between the liners and the parent metal. Features that rotate around a perimeter of the liner in the axial direction may provide interlocking in both the vertical and horizontal directions, thereby preventing or reducing movement of the liner in either direction, even if there is incomplete metallurgical bonding between the liner and the parent metal.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An extruded engine cylinder liner, comprising:

a cylindrical body having a longitudinal axis and defining an inner surface and an outer surface;

a plurality of spaced apart projections protruding from the outer surface, the projections being arranged in a rifled pattern such that each projection spirals around the outer surface, wherein each projection extends continuously along an entire height of the cylindrical body; and a wear-resistant coating disposed on the inner surface.

2. The liner of claim 1, wherein the plurality of spaced apart projections define a plurality of channels between adjacent projections, the channels being arranged in a rifled pattern.

3. The liner of claim 2, wherein the channels extend along the entire height of the cylindrical body.

4. The liner of claim 1, wherein the projections are equally spaced apart around a circumference of the outer surface.

5. The liner of claim 2, wherein each of the channels have a same width.

6. The liner of claim 1, wherein the cylindrical body is formed of aluminum or aluminum alloy.

7. The liner of claim 1, wherein the projections extend in a direction that is 20 to 70 degrees from the longitudinal axis.

8. The liner of claim 1, wherein the projections have a rectangular or triangular cross-sectional shape.

9. An engine block, comprising:

a body including a first material;

at least two cast-in cylinder liners including a second material metallurgically bonded to the body, the cylinder liners each including a plurality of spaced apart projections protruding from an outer surface thereof and extending in a direction oblique to a longitudinal axis of the liner, and channels defined between adjacent ones of the projections, wherein the first and second cylinder liners are arranged in the body such that one of the projections of the first cylinder liner is aligned with one of the channels of the second cylinder liner; and the first material surrounding and extending between the features.

10. The engine block of claim 9, wherein the plurality of spaced apart projections define a plurality of channels between adjacent projections, the channels extending in a direction oblique to the longitudinal axis.

11. The engine block of claim 10, wherein the first material substantially fills the plurality of channels.

12. The engine block of claim 9, wherein the first material surrounding and extending between the projections resists relative movement between the cast-in cylinder liners and the body in a vertical and a horizontal direction.

13. The engine block of claim 9, wherein the projections, for each of the cylinder liners, are arranged in a rifled pattern such that each projection spirals around the outer surface, wherein each projection extends continuously along an entire height of the cylindrical body.

14. A method comprising:

extruding a metal material through a die to form a cylindrical body defining an inner surface, and an outer surface having spaced apart protruding features;

rotating the die about a longitudinal axis during the extruding step such that the features have a rifled pattern;

sectioning the cylindrical body into cylinder liners; and applying a wear-resistant coating to the inner surface after the extruding and rotating steps and prior to the sectioning step.

15. The method of claim 14, wherein the die is continuously rotated during the extruding step such that the features extend continuously along the entire length of the cylinder body.

16. The method of claim 14, wherein each of the features extends continuously along an entire height of the cylindrical body.

17. The method of claim 14, wherein the die is rotated such that the features extend in a direction that is 20 to 70 degrees from the longitudinal axis.

* * * * *